US006792624B2

(12) United States Patent
Simmons

(10) Patent No.: US 6,792,624 B2
(45) Date of Patent: Sep. 21, 2004

(54) TEMPERATURE REGULATING CAP

(76) Inventor: John J. Simmons, 220 Ave. B West, Bismarck, ND (US) 58501

( * ) Notice: Subject to any disclaimer, the term of this patent is extended or adjusted under 35 U.S.C. 154(b) by 0 days.

(21) Appl. No.: 10/055,065

(22) Filed: Jan. 22, 2002

(65) Prior Publication Data

US 2002/0100106 A1 Aug. 1, 2002

Related U.S. Application Data

(60) Provisional application No. 60/264,818, filed on Jan. 26, 2001.

(51) Int. Cl.[7] ..... A42B 1/24

(52) U.S. Cl. ..... 2/209.13; 2/171.2; 607/110

(58) Field of Search ..... 2/209.13, 175.1, 2/195.1, 195.2, 171.2; 206/0.5, 438, 823; 239/36; 607/109, 110

(56) References Cited

U.S. PATENT DOCUMENTS

| | | | | |
|---|---|---|---|---|
| 1,567,931 A | | 12/1925 | Epler | |
| 2,263,395 A | | 11/1941 | Page | 2/181 |
| 2,403,676 A | | 7/1946 | Modlinski | 2/94 |
| 2,696,618 A | | 12/1954 | Hoffman et al. | 2/181 |
| 3,889,684 A | * | 6/1975 | Lebold | 607/109 |
| 3,988,568 A | | 10/1976 | Mantell | 219/211 |
| 4,190,054 A | | 2/1980 | Brennan | 128/402 |
| 4,204,543 A | | 5/1980 | Henderson | 128/402 |
| 4,326,533 A | | 4/1982 | Henderson | 128/402 |
| 4,425,917 A | | 1/1984 | Kuznetz | 128/403 |
| 4,576,169 A | | 3/1986 | Williams | 128/402 |
| 5,072,598 A | | 12/1991 | Dibrell | 62/259.3 |
| 5,088,549 A | | 2/1992 | Schneider | 165/46 |
| 5,163,425 A | * | 11/1992 | Nambu et al. | 607/110 |
| 5,197,292 A | | 3/1993 | McPherson | 62/56 |
| 5,295,949 A | | 3/1994 | Hathaway | 602/18 |
| 5,305,470 A | | 4/1994 | McKay | 2/7 |
| 5,313,668 A | | 5/1994 | Bogan et al. | 2/181.4 |
| 5,365,607 A | * | 11/1994 | Benevento et al. | 2/181.4 |
| 5,539,934 A | * | 7/1996 | Ponder | 2/413 |
| 5,557,807 A | * | 9/1996 | Hujar et al. | 2/171.2 |
| 5,605,144 A | | 2/1997 | Simmons | 126/204 |
| 5,887,284 A | * | 3/1999 | Simmons | 2/181.4 |

FOREIGN PATENT DOCUMENTS

| | | | |
|---|---|---|---|
| GB | 460200 | 9/1936 | |
| GB | 466141 | 11/1936 | |
| GB | 469769 | 2/1937 | |
| GB | 500270 | 4/1937 | |
| GB | 2130489 | 6/1984 | A61F/7/10 |

OTHER PUBLICATIONS

1996 Product Folder (4 pgs.): "Personal Cooling and Heating Clothing" Thermo–Cool Products, Inc.; 3811 Lockport St.; Bismarck ND.

1996 Product Label: "Keeps You Cool When the Heat Is On" for headbana bandana, neck wrap, wrist wrap—Thermo–Cool Products, Inc. 3811 Lockport St.; Bismarck, ND.

* cited by examiner

*Primary Examiner*—Katherine Moran
(74) *Attorney, Agent, or Firm*—James V Harmon

(57) ABSTRACT

Invention provides a temperature regulating cap for heating or cooling the head of the user having a removable and replaceable heating or cooling insert with a releasable connector for fastening the insert to the cap in which the insert has two portions including a first portion in contact with the top of the user's head for heating or cooling the head and a second portion that depends downwardly from the first portion and is located generally in the forehead region of the person's head to cool the forehead and to absorb perspiration. The insert can be removed and replaced when required for washing or for immersion in water to absorb moisture which is then retained in the insert for the purpose of providing evaporative cooling.

13 Claims, 4 Drawing Sheets

TEMPERATURE REGULATING CAP

This application claims the benefit of provisional application No. 60/264,818 filed Jan. 26, 2001.

FIELD OF THE INVENTION

This invention relates to clothing and more particularly to a hat or cap (both for convenience referred to herein as a cap) adapted to provide greater comfort by regulating the temperature of the head of the wearer.

BACKGROUND OF THE INVENTION

Attempts have been made to provide comfort under extreme conditions of heat or cold by furnishing a cap or hat that is capable of either cooling or heating the head of a person wearing the cap. Prior hats or caps of this kind have not been entirely satisfactory. Some are ineffective in providing adequate heating or cooling. In addition, a cap can easily be soiled with perspiration during hot weather. Besides being ineffective in operation, some prior products are not durable or are expensive to produce.

In view of these and other shortcomings of the prior art it is the general objective to provide an improved cap having a temperature regulating element that is removable, washable and highly effective in cooling or heating to provide comfort for the user as well as being able to absorb perspiration. It is a more specific object to provide evaporative cooling of the top of the head while at the same time providing a highly effective way of absorbing perspiration particularly in the region of the forehead.

A further objective is to provide a way of accommodating a heating element for heating the top of the head during cold weather while still permitting cooling in warm weather.

These and other more detailed and specific objects of the present invention will be better understood by reference to the following figures and detailed description which illustrate by way of example but a few of the various forms of the invention within the scope of the appended claims.

THE FIGURES

SUMMARY OF THE INVENTION

Figure 1:
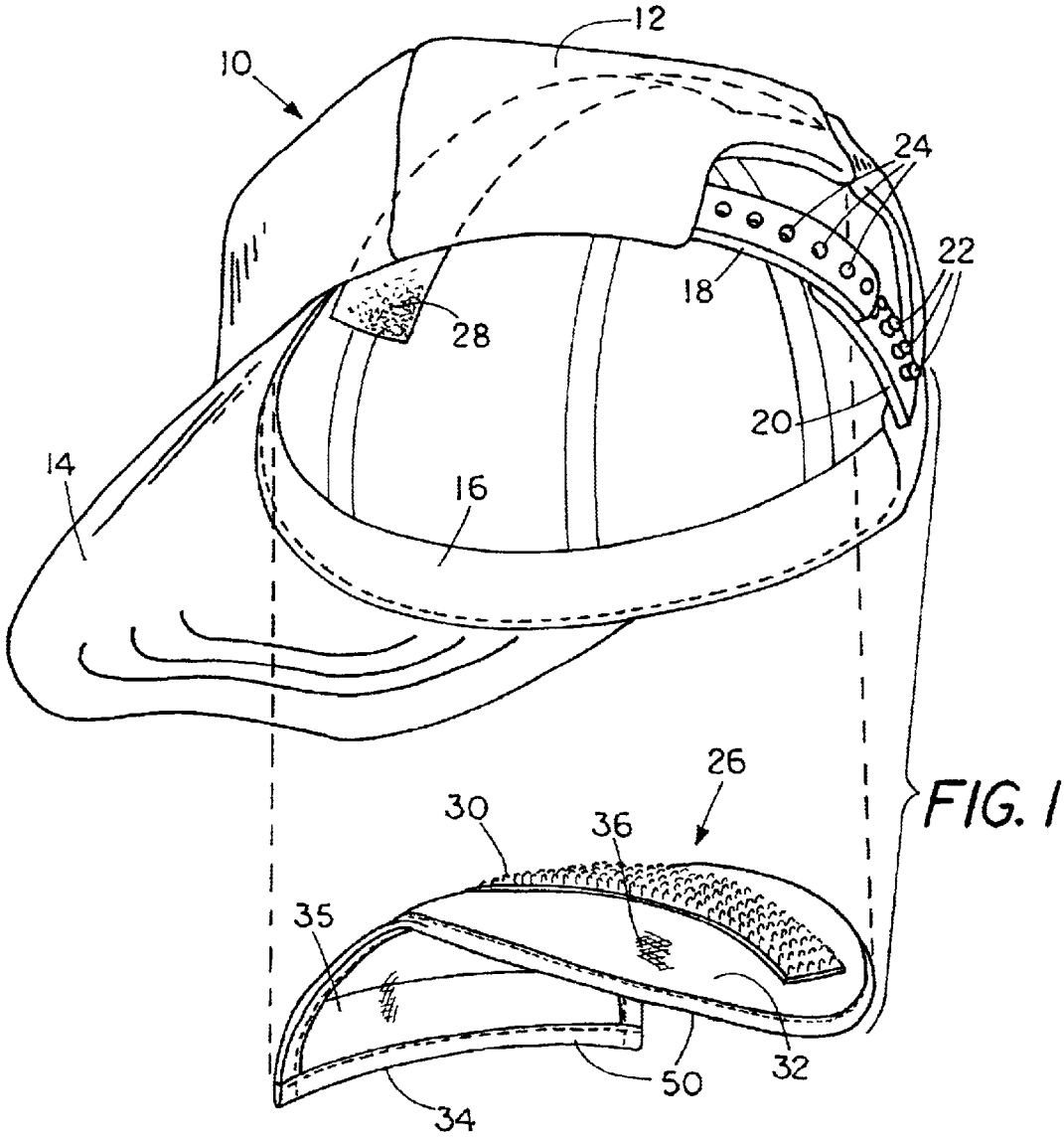
FIG. 1 is a perspective view of a cap embodying the invention with an insert portion removed for clarity of illustration.
Figure 2:
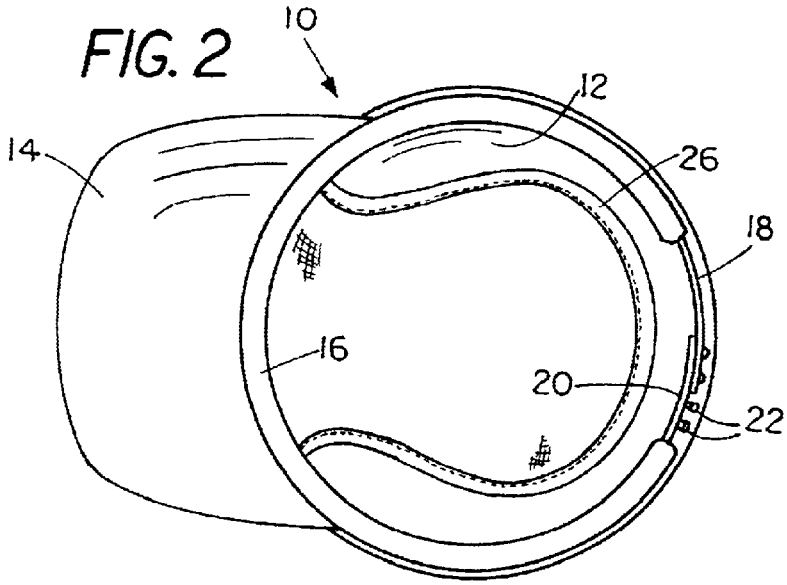
FIG. 2 is a bottom view of the cap with a cooling or heating insert in place.
Figure 3:
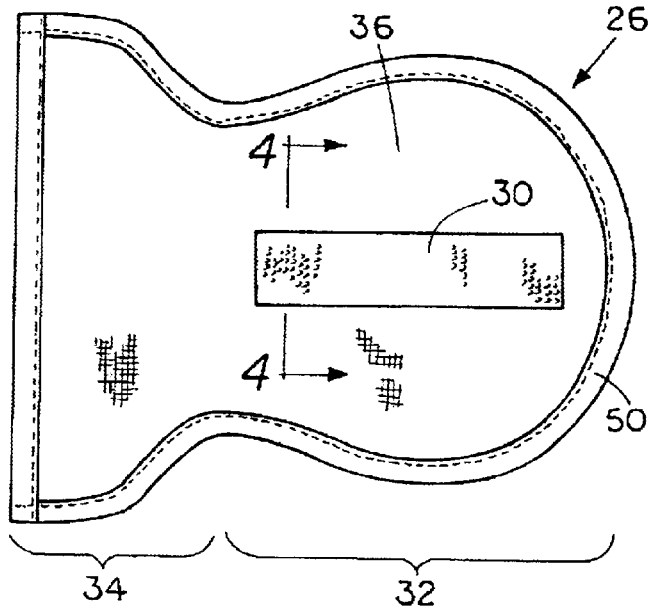
FIG. 3 is a top view of the cooling insert on a larger scale than is shown in FIG. 2.

Invention provides a temperature-regulating cap having a removable and replaceable heating or cooling insert element for heating or cooling the head of the user. A releasable connector is used to fasten the insert to the cap. The insert has two portions including a first portion in contact with the top of the user's head for heating or cooling the head and a second forwardly extending front portion that depends downwardly from the first portion and is located generally in the forehead region of the user's head to cool the forehead and to absorb perspiration. The insert can be removed and replaced when required for washing or for immersion in water to enable the insert to absorb moisture which is then retained in the insert to provide evaporative cooling.

DETAILED DESCRIPTION OF THE INVENTION

The cap cooling and sweat absorbing insert element is provided within and attached to the inner surface of the crown portion of a cap. The insert preferably includes a plurality of layers. It can be for example, a five layer structure consisting of a top layer of a moisture semi-permeable flexible sheet material such as a Nylon® fabric to which a one inch by five inch connector e.g., a hook and loop Velcro® hook fabric is attached by stitching, and a bottom layer of moisture semi-permeable poplin. These outer layers preferably enclose a three-piece layer composite which includes a sheet stock of non-woven super-absorbent polymer sandwiched between an upper and lower layer of cotton fabric. The three layer composite is stitched together in a quilted pattern to prevent a water containing gel that is formed by wetting the super absorbent polymer, from migrating or moving freely within the insert.

Prior to use, the cap insert that contacts the top of the wearer's head is soaked in cold water for 3 to 5 minutes. The super-absorbent portion of the inner composite three layer structure then absorbs about 150-times its weight of water. It will also absorb more than five times its weight in perspiration. As the water is absorbed a water containing gel forms which is encased and held within the composite fabric. The gel particles are larger than the fine openings in the cotton fabric and are therefor retained within the stitched pattern so as to prevent the water gel from migrating or moving freely from one side to the other.

The cold water containing gel provides a cooling effect to the top of the user's head, both directly and further by evaporative cooling. The super-absorbent polymer-containing composite also extends into the portion of the cap that contacts the forehead of the user. The super-absorbent within the composite will then absorb five or more times its weight in perspiration. The sweat from the wearer's forehead is absorbed by the super-absorbent polymer and is prevented from transferring to the cap sweatband by the semi-permeable fabric barrier. The semi-permeable fabric allows the passage of water or sweat, but since the sweat saturated gel particles are larger than the fine openings in both the inner cotton fabric and the outer semi-permeable fabric, they are retained within the cap insert. Thus, the invention provides cooling for the wearer as well as a superior sweat-absorbing capability.

If desired, the invention can also have an optional receptacle or pocket to accommodate an air activated heating pack. In this configuration, the cap insert provides heat to the wearer's head during cold weather. If desired, the heating pack can be replaced by a frozen or pre-chilled cold pack.

Refer now to the Figures which illustrate a temperature-regulating hat or cap for convenience referred to herein as a cap. The term cap herein is used broadly to refer to various forms of hats or caps. The cap is indicated generally by the numeral 10 and includes a crown portion 12 consisting of several generally triangular segments sewn together conventionally and a brim 14. Sewn into the inside of the cap 10 is a sweatband 16 of conventional construction at the rear end of which is provided a size adjustment strap consisting of two strap elements 18 and 20 of convention construction which can be connected to one another by means of studs 22 sized to be placed in various openings 24 so that the cap 10 fits the head of the user. Within the cap 10 is provided a releasable and replaceable insert 26 which is held in place during use by means of a releasable connector consisting of one or more strips of Velcro® or other complimentary hook and loop fasteners 28 and 30 which hold the insert 26 in place within the top of the hat 10 during use. Alternatively, the insert 26 can be held in place by snaps, buttons or other releasable connectors. However, if desired, it can be permanently secured e.g., by sewing.

Figure 4:
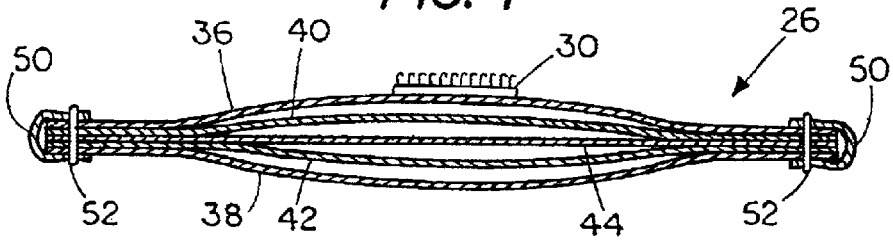
FIG. 4 is a vertical cross-sectional view taken on line 4—4 of FIG. 3.
Figure 5:
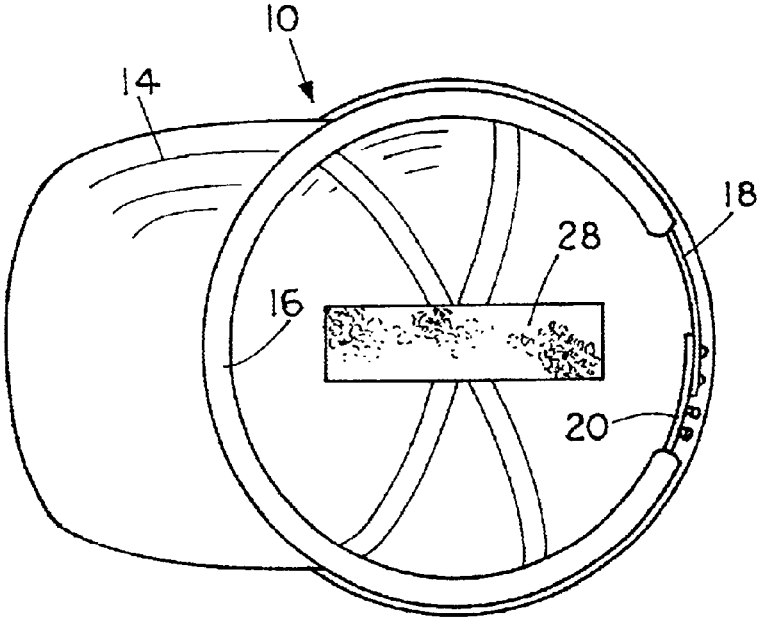
FIG. 5 is a bottom view of the cap with the insert removed.

The insert 26 includes a crown portion 32 and a forwardly and downwardly depending forehead portion 34. As shown best in FIG. 4, the insert 26 preferably comprises a plurality of fabric layers. The top layer 36 and the bottom layer 38 is preferably semi-permeable to moisture. The preferred top layer 36 consists of flexible sheet material such as poplin and the bottom layer 38 comprises a nylon fabric such as a fabric sold under the name Ultrex™ 660-47401 which is made by the Rose City Textiles company of Portland, Oreg. or Supplex™ Polaris, supplied by Venture Textiles Company of New York, N.Y. The Velcro® strip 30 is sewn to the top layer 36. Below the forehead portion 34 is a water permeable fabric layer 35 that can comprise poplin. Preferably enclosed between the top and bottom layers 36, 38 are three additional layers, including upper and lower porous layers of cloth such as cotton fabric 40 and 42 for enclosing a highly water-absorbent sheet stock 44 preferably formed from a non-woven polymeric super-absorbent fabric such as a sodium polyacrylic hydrocolloid polymer fiber sheet or laminate which is sold under the trademark Gelock 4026, by the Gelock International Corporation of Dunbridge, Ohio. The super-absorbent polymer layer 44 has the characteristic of being able to absorb and hold a large quantity of water as a hydrated gel for example about 150 or more times its own weight.

During use, the insert 26 is removed from the cap 10 and immersed in water. It is then rung out slightly. As a result, a water and gel mixture is formed by wetting the super absorbent polymer. The center three layers 40–44 of the composite can be stitched if desired to hold the layers together in a quilted pattern to prevent the water containing gel from migrating or moving freely within the composite. Adhesively secured points can be used in place of stitching if desired. This water and gel mixture or hydrogel has the characteristic of holding the water in place for along period of time to provide a cooling affect for the user during hot weather. On the edge of the insert 26 is provided a strip of fabric 50 which is stitched in place at 52 to hem the layers 36–42 together at their edges.

Figure 6:
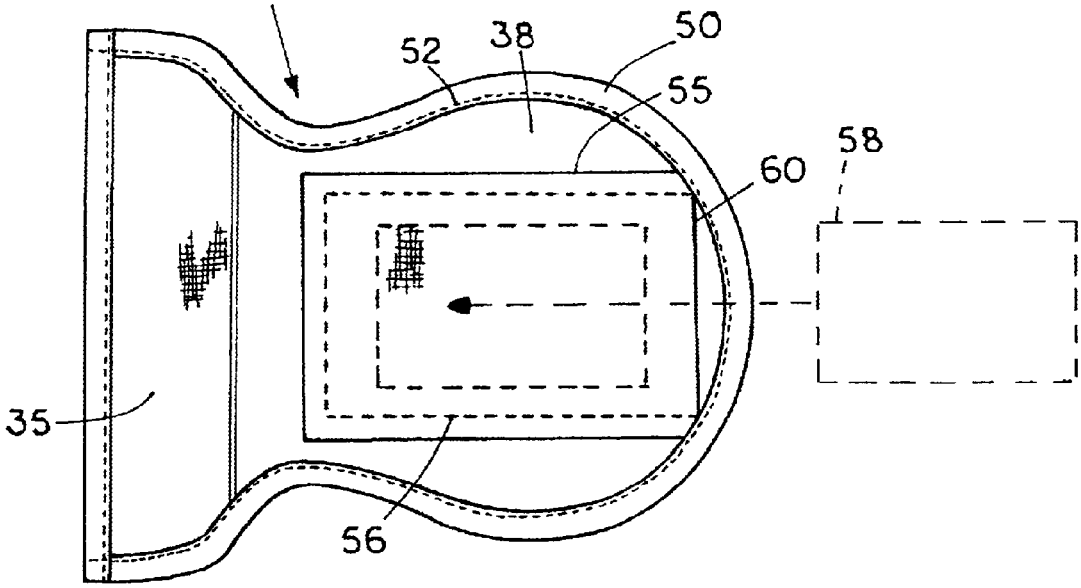
FIG. 6 is a bottom view of the cap insert showing the heating receptacle.
Figure 7:
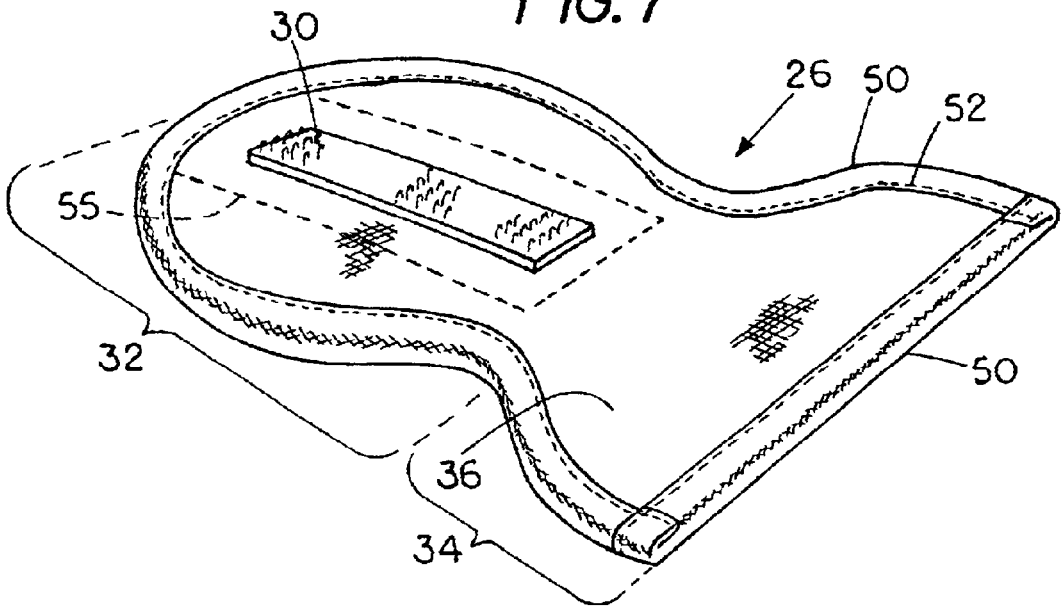
FIG. 7 is a top perspective view of the cap insert.

FIG. 6 shows an optional pocket 55 which is sewn along three edges at 56 to the lower layer 38 to provide a receptacle for any of various commercially available heating packets 58 which typically contain a mixture of salt, iron filings and sawdust that react when atmospheric moisture is allowed to enter the packet 58 to produce a heating effect over a period of up to several hours. The packet, when it is used, is inserted into the receptacle 55 through the open end at 60 for heating the user's head. When the heating packet 58 is used the insert 26 should not be wetted by immersing it in water.

The use of the invention will now be described for cooling the user during periods of hot weather. First, the insert 26 is removed from the cap 10 and especially the crown portion 32 of the insert 26 which contacts the top of the head is soaked in cold water for 3–5 minutes. The super-absorbent layer 44 especially but also the layers that enclose it absorb a large quantity of water. The super-absorbent layer 44 typically absorbs about 150 times its weight in water and more than 5 times its weight in perspiration. Then the water that is absorbed forms a water and gel mixture which is encased and held within the insert 26. The gel particles are larger than the fine openings in the cotton fabric of the layers 40 and 42 and are therefore retained between the upper and lower cotton layers 40 and 42. The quilted stitching retains the water and gel mixture within the layered structure preventing it from migrating or moving freely from one side to the other of the insert 26. During use the cold water contained in the gel provides a cooling effect for the top of the user's head both by direct cooling and also by evaporative cooling.

Figure 8:
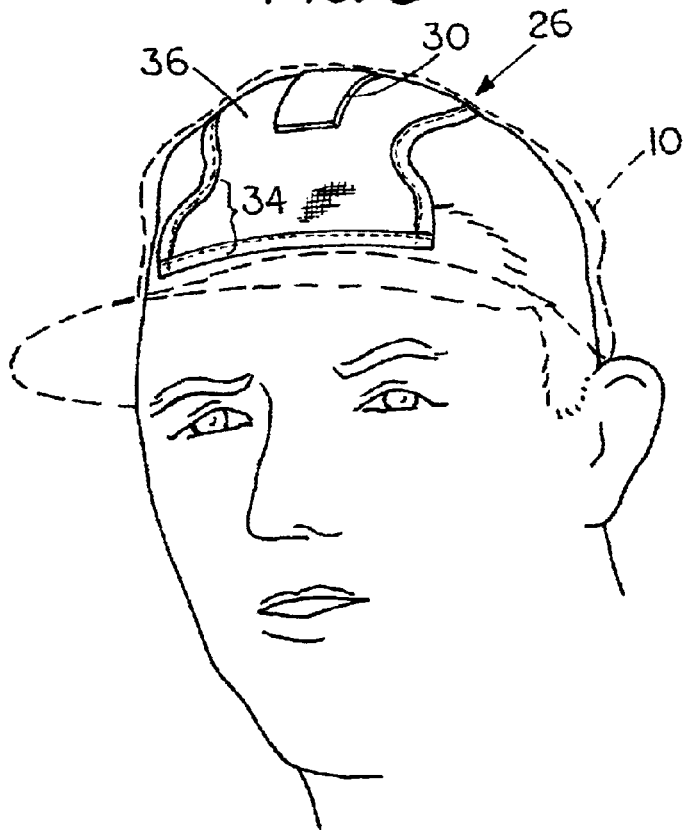
FIG. 8 is a front view of a person wearing a temperature regulating cap in accordance with the invention in which the cap is shown in dotted lines for clarity of illustration.

It should be noted that the water-absorbent polymer containing composite formed by the layers 36–44 also includes the depending portion 34 which contacts the user's forehead as shown in FIG. 8. Besides cooling the user's forehead through direct contact as well as evaporative cooling, the forehead contacting portion 34 also is capable of absorbing several times its own weight in perspiration. Moreover, the perspiration from the wearer's forehead is absorbed by the super-absorbent and is prevented from soiling the cap sweatband due to the presence of the semi-permeable fabric barrier 36 formed e.g. from poplin. This keeps the sweat band clean as the sweat that is absorbed forms hydrated gel particles which are too large to penetrate adjacent layers. Thus, the invention provides a removable and replaceable insert which prevents the cap from becoming soiled while at the same time providing heating or cooling for the wearer of the cap while providing a superior perspiration absorbing forehead covering.

Selected layers of fabric can be replaced if desired by non-permeable flexible sheet materials but at a slightly greater cost. Other variations of the present invention within the scope of the appended claims will be apparent to those skilled in the art once the principles described herein are understood.

What is claimed is:

1. A temperature regulating cap to provide comfort for the wearer of the cap, said cap comprising, a cap body, a unitary temperature regulating insert therewithin comprising at least one layer of flexible fabric, a connector for fastening the unitary insert within the cap, the unitary insert includes a water-absorbing element capable of providing a cooling effect for the user after the insert has been immersed in water, the unitary insert includes a crown portion wherein the crown portion is devoid of an opening above the top of the head during use such that the crown portion contacts the top of the head of the wearer while in use, a forwardly extending downwardly dependent front portion for cooling the forehead and absorbing perspiration during hot weather and the insert includes a receptacle for receiving a heating packet to provide heat to warm the head of the wearer during cold weather by supporting the heating packet in heat conductive relationship with the head of the wearer.

2. A temperature regulating cap to provide comfort for the wearer of the cap, said cap comprising, a cap body, a unitary temperature regulating insert therewithin comprising at least one layer of flexible fabric, a connector for fastening the unitary insert within the cap, the insert includes a water-absorbing element capable of providing a cooling effect for the user after the insert has been immersed in water, the unitary insert includes a crown portion that is centered above the top of the head, the crown portion is devoid of an opening above the top of the head during use such that the crown portion contacts the top of the head of the wearer while in use, a forwardly extending downwardly dependent front portion for cooling the forehead and absorbing perspiration during hot weather and a receptacle in the insert for receiving a heating packet to provide heat to warm the head of the wearer during cold weather by holding the heating packet in heat conductive relationship with the head of the wearer.

3. A temperature-regulating cap to provide comfort for the wearer of the cap, said cap comprising, a cap body, a unitary temperature regulating insert therewithin comprising at least one layer of flexible fabric, a connector for fastening the unitary insert within the cap, the unitary insert includes a water-absorbing element capable of providing a cooling effect for the user after the insert has been immersed in water, the unitary insert includes a crown portion that is centered above the top of the head and the crown portion is devoid of an opening above the top of the head during use such that the crown portion contacts the top of the head of the wearer while in use, a forwardly extending, downwardly dependent front portion for cooling the forehead and absorbing perspiration during hot weather, the connector is a releasable connector that is positioned between a top portion of the cap body and the portion of the crown that is centered over the top of the head, and said front portion of the insert hangs forwardly during use in contact with the forehead of the user.

4. The cap of claim 3 wherein the insert includes a top layer that is formed from water-permeable fabric.

5. The cap of claim 3 wherein the insert includes a lower outer layer that is semi-permeable to water.

6. The cap of claim 3 wherein the insert comprises a five layer composite including a lower moisture-permeable layer and an upper layer that are joined at thier edges to enclose a moisture-permeable composite comprising a moisture-absorbent layer sandwiched between an inner layer and an outer layer of fabric.

7. The cap of claim 3 having an insert including a three layer composite comprising a lower moisture transfer layer and an upper backing layer with a central moisture-absorbing layer enclosed therebetween.

8. The cap of claim 3 having an insert wherein an upper layer comprises poplin fabric.

9. The cap of claim 3 having an insert wherein the water-absorbing element contains a super-absorbent polymer.

10. The cap of claim 9 having an insert wherein the polymer is a hydrocolloid polymer adapted to form a gel when saturated with moisture.

11. The cap of claim 3 wherein the insert comprises a composite laminate formed from a plurality of flexible layers including and internal layer containing a super-absorbent polymer present both in the crown portion and in the front portion for forming a water and gel mixture when the insert is immersed in water and thereafter placed within the cap for cooling the head of the wearer.

12. The cap of claim 3 wherein the flexible fabric comprises a layer of nylon or poplin.

13. The cap of claim 3 wherein the water-absorbing element comprises a super-absorbent polymer in sheet form or a polymer supported upon a non-woven fabric.

* * * * *